US010201228B2

(12) United States Patent
Gonzalez et al.

(10) Patent No.: US 10,201,228 B2
(45) Date of Patent: Feb. 12, 2019

(54) SUPPORT BRACKET

(71) Applicant: SPG International LLC, Covington, GA (US)

(72) Inventors: Arturo Gonzalez, Lilburn, GA (US); Steven M. Kessell, Loganville, GA (US); Michael D. Potter, Marydel, DE (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 14/840,254

(22) Filed: Aug. 31, 2015

(65) Prior Publication Data

US 2015/0366339 A1 Dec. 24, 2015

Related U.S. Application Data

(63) Continuation of application No. 13/830,962, filed on Mar. 14, 2013, now Pat. No. 9,119,471.

(51) Int. Cl.
*A47B 57/48* (2006.01)
*A47B 96/06* (2006.01)
(Continued)

(52) U.S. Cl.
CPC ..... *A47B 57/485* (2013.01); *A47B 96/06* (2013.01); *A47B 96/061* (2013.01);
(Continued)

(58) Field of Classification Search
CPC . A47B 57/485; A47B 96/061; A47B 96/1408; A47B 57/06; A47B 57/42;
(Continued)

(56) References Cited

U.S. PATENT DOCUMENTS 239,909 A 4/1881 Woodward
291,030 A 1/1884 Clapper
(Continued)

FOREIGN PATENT DOCUMENTS

CN 1132999 10/1995
CN 101868166 A 10/2010
(Continued)

OTHER PUBLICATIONS

Extended European Search Report for Application No. 14775083.0 dated Feb. 15, 2017 (8 pages).
(Continued)

*Primary Examiner* — Nkeisha Smith

(74) *Attorney, Agent, or Firm* — Michael Best & Friedrich LLP

(57) ABSTRACT

A shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

26 Claims, 6 Drawing Sheets

(51) Int. Cl.
*A47B 96/14* (2006.01)
*A47B 57/00* (2006.01)
*A47B 57/30* (2006.01)

(52) U.S. Cl.
CPC ..... *A47B 96/1408* (2013.01); *A47B 57/00* (2013.01); *A47B 57/30* (2013.01)

(58) Field of Classification Search
CPC ..... A47B 57/028; A47B 57/45; A47B 57/00; A47B 57/08; A47B 57/20; A47B 57/30; A47B 57/32; A47B 57/34
USPC ..... 248/250, 235, 247, 248, 245, 220.42, 248/220.43, 243; 108/106, 107, 147.17; 211/187, 189, 190, 193, 90.01, 90.02, 211/90.03
See application file for complete search history.

(56) References Cited

U.S. PATENT DOCUMENTS 309,360 A 12/1884 Roberts
663,784 A 12/1900 Porter
870,439 A 11/1907 Kade
1,424,284 A 8/1922 Dyke
1,560,122 A 11/1925 Vance
1,582,100 A 4/1926 Troppman
1,620,841 A 3/1927 Vance
1,698,974 A 1/1929 Vance
1,702,937 A * 2/1929 Friedemann ..... A47F 3/12 248/242
1,983,858 A 12/1934 Karnes
2,008,180 A 7/1935 Karnes
2,246,090 A 6/1941 Filer
2,263,282 A 11/1941 Welch et al.
2,534,952 A 12/1950 Comer
2,693,884 A 11/1954 Gurries
2,772,846 A 12/1956 Skar
2,788,949 A 4/1957 Gurries
2,790,559 A 4/1957 Stephenson et al.
2,912,119 A 11/1959 Robinson
2,919,034 A 12/1959 Levy
2,933,196 A 4/1960 Childs
2,940,601 A 6/1960 Smith
2,940,603 A 6/1960 Riedmaier et al.
2,971,805 A 2/1961 Weiss
2,975,908 A 3/1961 Huet
2,983,389 A 5/1961 Trautmann
3,018,900 A 1/1962 Huet
RE25,156 E 4/1962 Gingher et al.
3,040,905 A 6/1962 Gingher et al.
3,044,632 A 7/1962 Schild
3,044,634 A 7/1962 Oztekin
3,057,483 A 10/1962 Derman
3,097,822 A 7/1963 Attwood
3,100,572 A 8/1963 Gingher et al.
3,127,146 A 3/1964 Fisher
3,130,693 A 4/1964 Shell
3,184,068 A 5/1965 Wende
3,194,528 A 7/1965 Chesley
3,199,822 A 8/1965 Ruhnke
3,207,322 A 9/1965 Pedersen
3,212,648 A 10/1965 Baker, Jr. et al.
3,216,377 A 11/1965 Gunn
3,221,678 A 12/1965 Doherty
3,229,822 A 1/1966 Janus
3,229,823 A 1/1966 Hummer
3,250,584 A 5/1966 Tassell
3,273,847 A 9/1966 Berman
3,294,351 A 12/1966 Rollins, Jr.
3,316,863 A 5/1967 Zock
3,353,684 A 11/1967 Chesley
3,355,134 A 11/1967 Chesley
3,358,956 A 12/1967 Thornton
3,371,798 A 3/1968 D'Altrui
3,450,270 A 6/1969 Brown
3,471,112 A 10/1969 MacDonald et al.
3,479,975 A 11/1969 Ferdinand et al.
3,495,718 A 2/1970 Romero
3,512,654 A 5/1970 Olsen et al.
3,517,623 A 6/1970 Goldstein et al.
3,556,306 A 1/1971 Shell
3,561,608 A 2/1971 Weider et al.
3,565,020 A 2/1971 Schier
3,565,381 A 2/1971 Oliver
3,572,626 A 3/1971 Bertschi
3,587,867 A 6/1971 Fenwick
3,595,404 A 7/1971 Goldstein
3,602,159 A 8/1971 Marschak
3,602,374 A 8/1971 Alabaster
3,612,291 A 10/1971 Skubic
3,627,247 A 12/1971 Krikorian
3,631,821 A 1/1972 Zachariou
3,645,486 A 2/1972 Ferdinand et al.
3,695,569 A 10/1972 Pullan
3,701,325 A 10/1972 Fenwick
3,730,108 A 5/1973 Stroh
3,740,776 A * 6/1973 Lazarus ..... A47C 19/022 5/296
3,759,191 A 9/1973 Freeman
3,765,344 A 10/1973 Ferdinand et al.
3,784,025 A 1/1974 Dumit
3,793,655 A 2/1974 Harris et al.
3,827,377 A 8/1974 Aughtry, Jr.
3,854,686 A 12/1974 Konstant
3,885,675 A 5/1975 Hultenby et al.
3,993,002 A 11/1976 Stroh
4,018,167 A 4/1977 Spangler
4,064,996 A 12/1977 Shillum
4,098,480 A 7/1978 Neumann
4,101,108 A 7/1978 Klein
4,109,797 A 8/1978 Brunette
4,116,509 A 9/1978 Smith
4,122,955 A 10/1978 Celms
4,146,140 A 3/1979 Suter et al.
4,150,753 A 4/1979 Stahl et al.
4,174,086 A 11/1979 Verberkmoes
4,189,123 A 2/1980 Johnson
4,190,002 A 2/1980 Redemann
4,197,950 A 4/1980 Ovitz, III
4,201,139 A * 5/1980 Suttles ..... A47B 57/40 108/109
4,205,815 A 6/1980 Sauer et al.
4,230,052 A 10/1980 Champagne
4,285,436 A 8/1981 Konstant et al.
4,286,719 A 9/1981 Hall
4,312,086 A 1/1982 Bianco
4,332,204 A 6/1982 Hewell
4,360,181 A 11/1982 Burkholder
4,367,819 A 1/1983 Lewis
4,378,925 A 4/1983 Griffin
4,390,302 A 6/1983 Sanfeliu-Marimon
4,396,125 A 8/1983 Rowader
4,397,432 A 8/1983 Resetar
4,444,323 A 4/1984 Travis
4,455,007 A 6/1984 Varon et al.
4,534,529 A 8/1985 Dorner
4,589,349 A 5/1986 Gebhardt et al.
4,592,286 A 6/1986 Trubiano
4,615,503 A 10/1986 Garfinkle
4,623,065 A 11/1986 Cooper
4,624,376 A 11/1986 Bertram
4,627,543 A 12/1986 Nicely
4,684,094 A 8/1987 Everett
4,700,916 A 10/1987 Bastian et al.
4,938,442 A 7/1990 Mastrodicasa
4,951,908 A 8/1990 Kallio
4,960,210 A 10/1990 Spamer
D311,858 S 11/1990 Richmond
5,022,541 A 6/1991 White
5,054,404 A 10/1991 Melgers
5,069,408 A 12/1991 Bessinger
5,074,422 A 12/1991 Holtz
5,080,238 A 1/1992 Hochman

(56) References Cited

U.S. PATENT DOCUMENTS 5,116,007 A 5/1992 Von Gunton et al.
5,127,342 A 7/1992 Taylor
5,161,701 A 11/1992 Berny
D331,873 S 12/1992 Finkelstein et al.
D333,059 S 2/1993 Cohn et al.
5,205,630 A 4/1993 Welch
5,221,014 A 6/1993 Welch et al.
5,230,492 A 7/1993 Zwart et al.
D339,704 S 9/1993 Cohn et al.
5,263,595 A 11/1993 Hilstolsky
5,265,740 A 11/1993 Hodsden et al.
5,269,419 A 12/1993 Aldeguer et al.
5,288,046 A 2/1994 Eklof et al.
5,297,486 A 3/1994 Herrmann et al.
5,303,645 A 4/1994 Meacham
5,305,898 A 4/1994 Merl
5,346,077 A 9/1994 Randall
5,350,074 A 9/1994 Rosenband
5,351,842 A 10/1994 Remmers
5,365,860 A 11/1994 Billington, III
5,390,803 A 2/1995 McAllister
5,405,114 A 4/1995 Dias
D358,321 S 5/1995 Tayar
5,415,302 A 5/1995 Carlson et al.
5,417,396 A 5/1995 Merl
5,423,251 A 6/1995 Kolvites et al.
5,437,426 A 8/1995 MacDonald
5,443,167 A 8/1995 Menaged et al.
5,454,638 A 10/1995 Bird et al.
5,456,435 A 10/1995 Sweeney
5,456,438 A 10/1995 Long
5,472,103 A 12/1995 Merl
5,477,971 A 12/1995 Howard
5,482,168 A 1/1996 Welch et al.
5,509,541 A 4/1996 Merl
5,518,127 A 5/1996 Warmack et al.
5,522,324 A 6/1996 van Gelder et al.
5,531,168 A 7/1996 Towfigh
5,575,444 A 11/1996 Otema
5,592,886 A 1/1997 Williams et al.
5,605,238 A 2/1997 Jacobs
5,611,440 A 3/1997 Moller
5,613,449 A 3/1997 Pullman
5,641,081 A 6/1997 Merl
5,645,257 A 7/1997 Ward
5,647,650 A 7/1997 Daugherty et al.
5,655,740 A 8/1997 Lazarus
5,680,942 A 10/1997 McAllister et al.
5,695,163 A 12/1997 Tayar
5,715,957 A 2/1998 Merl
5,769,247 A 6/1998 Merl
5,794,902 A 8/1998 Henry et al.
5,797,501 A 8/1998 Von Gunten
5,797,503 A 8/1998 Stevens
5,806,820 A 9/1998 Simon
5,816,419 A 10/1998 Lamson
5,833,083 A 11/1998 Miller
5,868,263 A 2/1999 McAllister et al.
5,884,567 A 3/1999 Bartz, Jr.
5,908,119 A 6/1999 Kump et al.
5,915,803 A 6/1999 Daugherty
5,921,190 A 7/1999 Wood
5,921,411 A * 7/1999 Merl ..... A47B 96/00 108/108
5,921,414 A 7/1999 Burke et al.
D415,365 S 10/1999 Nicklas
5,970,887 A 10/1999 Hardy
5,979,677 A 11/1999 Simpson, II et al.
6,017,009 A 1/2000 Swartz et al.
6,019,331 A 2/2000 Hoogland et al.
6,024,333 A 2/2000 Raasch et al.
6,029,833 A 2/2000 Yeh
6,053,115 A 4/2000 Felton
6,062,401 A 5/2000 Hall et al.
6,082,690 A 7/2000 Durin et al.
6,109,461 A 8/2000 Kluge et al.
6,116,436 A 9/2000 Ferrucci et al.
6,129,224 A 10/2000 Mingers
6,158,599 A 12/2000 Lazarus
6,182,937 B1 2/2001 Sanderse
6,230,907 B1 5/2001 Stuart
6,253,687 B1 7/2001 McAllister
6,267,064 B1 7/2001 Ostertag et al.
6,269,906 B1 8/2001 Dockter et al.
6,302,283 B1 10/2001 Yeh
6,345,795 B1 2/2002 Bartz, Jr.
6,431,090 B1 8/2002 Davis et al.
D462,541 S 9/2002 Welch
6,460,946 B1 10/2002 Beukema
6,481,678 B1 * 11/2002 Chong ..... H02G 3/288 211/192
6,555,740 B2 4/2003 Roth et al.
6,584,916 B1 7/2003 Felton et al.
6,625,935 B1 9/2003 King et al.
6,659,295 B1 12/2003 De Land et al.
6,666,344 B1 12/2003 Schneider
6,675,725 B2 1/2004 Felton et al.
6,726,035 B2 4/2004 Zadak
RE38,517 E 5/2004 Pfeiffer et al.
6,848,589 B2 2/2005 Wood
6,918,499 B2 7/2005 De Land et al.
6,932,225 B2 8/2005 Rowe
6,935,518 B2 8/2005 Winig et al.
6,971,528 B2 12/2005 Chen
7,040,494 B2 5/2006 Harper
7,086,543 B2 8/2006 Remmers
7,128,223 B1 * 10/2006 Sarnoff ..... A47F 5/083 211/103
7,147,114 B2 12/2006 Sarnoff et al.
7,150,361 B2 12/2006 Calleja
7,191,907 B2 3/2007 Conway
7,191,908 B2 3/2007 De Rijk
7,240,803 B2 7/2007 Stitchick et al.
7,258,317 B1 8/2007 Nagel
7,284,671 B1 10/2007 Doscher
7,311,211 B2 12/2007 Chung
7,350,649 B1 4/2008 Martens
7,357,362 B2 * 4/2008 Yang ..... A47B 88/044 248/220.22
7,378,213 B2 5/2008 Smalley
7,387,212 B2 6/2008 Costa et al.
7,387,213 B1 * 6/2008 Smalley ..... A47B 57/482 211/106
7,401,705 B2 7/2008 Craft
7,404,533 B1 7/2008 Kologe
7,407,060 B2 8/2008 Swartz et al.
7,494,019 B2 * 2/2009 Kessell ..... A47B 57/06 108/108
7,497,344 B2 * 3/2009 Chen ..... A47B 57/40 108/108
7,506,772 B2 3/2009 Chen
7,523,903 B1 4/2009 Rindoks et al.
7,568,436 B2 8/2009 McAllister et al.
7,654,497 B1 2/2010 Karan
7,677,514 B1 3/2010 Palmer
7,762,411 B2 * 7/2010 Hilburn ..... A47B 88/044 211/192
7,810,438 B2 10/2010 Ryberg
7,832,571 B2 11/2010 Felsenthal
7,900,783 B2 3/2011 Fernandez et al.
7,967,156 B2 6/2011 Hsu
7,967,268 B2 * 6/2011 Herron, III ..... A47B 57/42 108/106
7,992,731 B2 8/2011 McAllister et al.
8,025,163 B2 9/2011 McAllister et al.
8,028,846 B2 10/2011 Peota et al.
8,087,521 B2 1/2012 Schwartzkopf et al.
8,113,678 B2 2/2012 Babcock et al.
8,118,181 B2 2/2012 Shinozaki
8,141,724 B2 3/2012 Northam et al.
8,152,119 B2 4/2012 Pfund et al.
8,235,339 B2 8/2012 Selvidge et al.
8,424,466 B2 4/2013 Botkin

(56) References Cited

U.S. PATENT DOCUMENTS

| | | | |
|---|---|---|---|
| 8,468,844 | B2 | 6/2013 | Nagel et al. |
| 8,584,873 | B2 | 11/2013 | Horn et al. |
| 8,596,590 | B2 | 12/2013 | McCoy |
| 8,602,372 | B2 | 12/2013 | Yu et al. |
| 8,646,624 | B2 | 2/2014 | Fernandez et al. |
| D702,467 | S | 4/2014 | Huang et al. |
| 8,967,576 | B2 | 3/2015 | Knoll et al. |
| 9,119,471 | B2 | 9/2015 | Gonzalez et al. |
| 9,173,506 | B2 | 11/2015 | Andersson et al. |
| 9,277,814 | B2 | 3/2016 | Winker |
| 9,339,108 | B2 | 5/2016 | Zang et al. |
| 9,770,122 | B2 | 9/2017 | Gonzalez et al. |
| D808,200 | S | 1/2018 | Davis et al. |
| 9,883,755 | B2 | 2/2018 | Gonzalez et al. |
| 2002/0104938 | A1 | 8/2002 | Simard |
| 2003/0037712 | A1 | 2/2003 | Welch et al. |
| 2003/0160012 | A1 | 8/2003 | Kanouchi et al. |
| 2003/0234231 | A1 | 12/2003 | Rowe |
| 2004/0020885 | A1 | 2/2004 | Newman |
| 2004/0045919 | A1 | 3/2004 | Remmers |
| 2004/0050814 | A1 | 3/2004 | Roush et al. |
| 2004/0154498 | A1 | 8/2004 | Borgen et al. |
| 2004/0159622 | A1 | 8/2004 | Craft et al. |
| 2004/0173549 | A1 | 9/2004 | Herron, III et al. |
| 2004/0182805 | A1 | 9/2004 | Harper |
| 2005/0045787 | A1 | 3/2005 | Magnusson |
| 2005/0056604 | A1 | 3/2005 | Chen |
| 2005/0092706 | A1 | 5/2005 | Chang |
| 2005/0103733 | A1 | 5/2005 | Saltzberg et al. |
| 2005/0103734 | A1 | 5/2005 | Saltzberg et al. |
| 2005/0127017 | A1 | 6/2005 | Kessel et al. |
| 2005/0145147 | A1 | 7/2005 | Costa et al. |
| 2005/0145588 | A1 | 7/2005 | Stitchick et al. |
| 2005/0150850 | A1 | 7/2005 | Stitchick et al. |
| 2005/0199568 | A1 | 9/2005 | Gay, II et al. |
| 2006/0054577 | A1 | 3/2006 | Strating et al. |
| 2006/0091088 | A1 | 5/2006 | McCoy |
| 2006/0175495 | A1 | 8/2006 | Gregory |
| 2006/0213849 | A1 | 9/2006 | Bienick |
| 2007/0110511 | A1 | 5/2007 | Chen |
| 2007/0114348 | A1 | 5/2007 | Nawrocki |
| 2007/0138362 | A1 | 6/2007 | McAllister et al. |
| 2007/0241072 | A1 | 10/2007 | Bryant et al. |
| 2007/0295681 | A1 | 12/2007 | Colin |
| 2008/0047914 | A1 | 2/2008 | Young |
| 2008/0083685 | A1* | 4/2008 | Chen ..... A47F 5/0018 211/134 |
| 2008/0128373 | A1 | 6/2008 | Chang et al. |
| 2008/0142463 | A1 | 6/2008 | Johnson |
| 2008/0179267 | A1 | 7/2008 | Johnson |
| 2008/0217496 | A1 | 9/2008 | Wooten |
| 2008/0237426 | A1 | 10/2008 | Walters |
| 2009/0014400 | A1 | 1/2009 | Nawrocki |
| 2009/0139943 | A1 | 6/2009 | Fernandez |
| 2010/0032394 | A1 | 2/2010 | Wang |
| 2010/0140202 | A1 | 6/2010 | Janis |
| 2010/0155353 | A1 | 6/2010 | McAllister et al. |
| 2010/0163504 | A1 | 7/2010 | Freeman |
| 2010/0200716 | A1* | 8/2010 | White, III ..... H05K 7/1489 248/243 |
| 2010/0327135 | A1 | 12/2010 | Selvidge et al. |
| 2011/0168651 | A1 | 7/2011 | Stenftenagel et al. |
| 2011/0220602 | A1 | 9/2011 | Chen |
| 2012/0175330 | A1 | 7/2012 | Nicholls et al. |
| 2012/0255924 | A1 | 10/2012 | Kologe |
| 2012/0273447 | A1 | 11/2012 | Stitchick et al. |
| 2012/0292271 | A1 | 11/2012 | Bevelacqua |
| 2013/0020272 | A1 | 1/2013 | Kropveld |
| 2013/0020452 | A1 | 1/2013 | Yu et al. |
| 2013/0021391 | A1 | 1/2013 | Rui |
| 2014/0263125 | A1 | 9/2014 | Gonzalez et al. |
| 2015/0335155 | A1 | 11/2015 | Winker |
| 2015/0366339 | A1 | 12/2015 | Gonzalez et al. |
| 2016/0015174 | A1 | 1/2016 | Guizzardi |
| 2017/0310090 | A1 | 10/2017 | Woodley et al. |
| 2017/0332782 | A1 | 11/2017 | Castro |
| 2017/0340108 | A1 | 11/2017 | Gonzalez et al. |
| 2017/0340142 | A1 | 11/2017 | Gonzalez et al. |

FOREIGN PATENT DOCUMENTS

| | | | |
|---|---|---|---|
| CN | 102131426 | A | 7/2011 |
| DE | 1138902 | | 10/1962 |
| DE | 2824605 | A1 | 12/1979 |
| DE | 9109395 | | 9/1991 |
| DE | 20215552 | U1 | 2/2003 |
| FR | 1515478 | | 3/1968 |
| GB | 608480 | A | 9/1948 |
| GB | 1025357 | | 1/1963 |
| GB | 1149568 | | 6/1967 |
| GB | 2194134 | | 3/1988 |
| KR | 101267731 | B1 | 5/2013 |
| WO | 9529613 | A1 | 11/1995 |
| WO | 03088782 | A2 | 10/2003 |
| WO | 2005046401 | | 5/2005 |
| WO | 2013071977 | A1 | 5/2013 |

OTHER PUBLICATIONS

Extended European Search Report for Application No. 14775083.0 dated Jun. 21, 2017 (9 pages).

International Search Report and Written Opinion received in International Patent Application No. PCT/US2014/026525 dated Jul. 28, 2014 (9 pages).

Metro, "Metro Cantilevered Freestanding Shelving System," article (2001) 5 pages, www.metro.com.

Eagle Group, "Cantilever Shelving," article, EG7010 Rev. 3 (2005) 4 pages, www.eaglegrp.com.

Modern Equipment Company, Inc., "Meco Omaha Cantilever Rack, Buyers Guide" online brochure (2001) 12 pages.

Modern Equipment Company, Inc., "Instructions for Assembling Meco Omaha Series 2000 Medium—Heavy Duty Cantilever Rack" online brochure (2013) 6 pages, www.meco-omaha.com.

EZ Shelving Systems, Inc., "Manufacturer of Space-Saving Cantilever Shelving & Hardware," catalog (2005) pp. 1-8, Merriam, USA website: www.e-zshelving.com.

EZ Shelving Systems, Inc., "Manufacturer of Space-Saving Cantilever Shelving & Hardware," catalog (2008) pp. 1-4, Merriam, USA website: www.e-zshelving.com.

Second Office Action and Search Report from the State Intellectual Property Office of the People's Republic of China for Application No. 201480024336.X dated Aug. 21, 2017 (8 pages).

U.S. Appl. No. 15/675,368, filed Aug. 11, 2017, in re Arturo Gonzalez, entitled "Shelving System" (27 pages).

Office Action received in U.S. Appl. No. 15/675,368, dated Oct. 6, 2017 (7 pages).

Defendant's Amended Answer and Counterclaims, U.S. District Court, Middle District of Tennessee Nashville Division, *SPG International, LLC* v. *Intermetro Industries Corp*, Case No. 13:18-cv-00116, filed Apr. 5, 2018 (18 pages).

Limited Warranty and Assembly Instructions, Nexel Industries Inc., believed to be available to the public before Mar. 14, 2013, (3 pages).

"Shelf Types," catalog, Nexel Industries Inc., Sep. 28, 2010, (58 pages).

Statement of Relevance with photo of shelving system asserted by Defendant in *SPG International, LLC* v. *Intermetro Industries Corp*, Case No. 3:18-cv-00116 as a cantilever shelving system made by Nexel Industries, Inc. and available to the public since at least about Oct. 2011, (2 pages).

First Office Action and Search Report from the State Intellectual Property Office of the People's Republic of China for Application No. 201480024336.X dated Dec. 28, 2016 (16 pages).

Complaint for Patent Infringement, U.S. District Court, Middle District of Tennessee Nashville Division, *SPG International, LLC* v. *Intermetro Industries Corp*, Case No. 13:18-cv-00116, filed Feb. 8, 2018 (6 pages).

(56) References Cited

OTHER PUBLICATIONS

U.S. Appl. No. 15/886,636, filed Feb. 1, 2018, in re Arturo Gonzalez, entitled "Shelving System" (27 pages).
"Cantilever Shelving System," catalog, Nexel Industries Inc., believed to be available to the public before Mar. 14, 2013, Nexelwire.com, (1 page).
"Corrosion Resistant Cantilever Rack," website, Global Industrial, Nov. 18, 2011, globalindustrial.com, (2 pages).
"Corrosion Resistant Cantilever Rack Upright," website, Global Industrial, Oct. 17, 2011, globalindustrial.com, (3 pages).
"Storage and Handling Equipment," catalog, Nexel Industries Inc., Jul. 24, 2010, http://www.nexelwire.com:80/catalog/, (1 page).
Statement of Relevance with photos showing select components of a cantilever shelving system of Nexel Products, Inc., believed to be available to the public before Mar. 14, 2013, (11 pages).
"Button-On Cantilever Rack Specification," webpage, https://web.archive.org/web/20061019070526/http://www.jarke.com/pro...; Jarke, Prospect Heights, IL, 2006, produced by InterMetro Industries Corp in Case No. 13:18-cv-00116, *SPG International, LLC* v. *InterMetro Industries Corp*, (3 pages).
"Cantilevered Shelving System—Heavy Duty Components," Eagle Group, Clayton, DE, specification sheet, 2010, produced by InterMetro Industries Corp in Case No. 13:18-cv-00116, *SPG International, LLC* v. *InterMetro Industries Corp*, (2 pages).
"Cantilever Shelving," Eagle Group, Clayton, DE, catalog, 2005, produced by InterMetro Industries Corp in Case No. 13:18-cv-00116, *SPG International, LLC* v. *InterMetro Industries Corp*, (4 pages).
"Chapter 3—Installing FlexWorks Accessories," Lista International Corporation, Holliston, MA, guide, 2000, produced by InterMetro Industries Corp in Case No. 13:18-cv-00116, *SPG International, LLC* v. *InterMetro Industries Corp*, (14 pages).
"FreedomRail Installation Guide," Organized Living, Cincinnati, OH, guide, 2009, produced by InterMetro Industries Corp in Case No. 13:18-cv-00116, *SPG International, LLC* v. *InterMetro Industries Corp*, (3 pages).
"HD Super Work Center With Overhead," InterMetro Industries Corporation, Wilkes-Bane, PA, specification sheet, 1999, produced by InterMetro Industries Corp in Case No. 13:18-cv-00116, *SPG International, LLC* v. *InterMetro Industries Corp*, (2 pages).
"Shelving and Shelving Solutions," Eagle Group, Clayton, DE, catalog, 2009, produced by InterMetro Industries Corp in Case No. 13:18-cv-00116, *SPG International, LLC* v. *InterMetro Industries Corp*, (16 pages).
"Material Handling and Industrial Storage Solutions," SPG International, LLC, Covington, GA, Catalog, 2010, produced by InterMetro Industries Corp in Case No. 13:18-cv-00116, *SPG International, LLC* v. *InterMetro Industries Corp*, (27 pages).
"Super Erecta Shelf Post—Type and Direct Wall Mounts," InterMetro Industries, Wilkes-Bane, PA, specification sheet, 2000, produced by InterMetro Industries Corp in Case No. 13:18-cv-00116, *SPG International, LLC* v. *InterMetro Industries Corp*, (2 pages).
"Wire Basket with Brackets 36" × 16," Global Equipment Company, Inc., https://web.archive.org/web/20120507140028/http://www.globalindustria\'85; web page, 2012, produced by InterMetro Industries Corp in Case No. 13:18-cv-00116, *SPG International, LLC* v. *InterMetro Industries Corp*, (3 pages).
Extended European Search Report for Application No. 18156976.5, dated May 15, 2018, European Patent Office, produced by InterMetro Industries Corp in Case No. 13:18-cv-00116, *SPG International, LLC* v. *InterMetro Industries Corp*, (4 pages).
"Corrosion Resistant Cantilever Rack—Adjustable Width Uprights & Frame (Only)," Global Industrial, 2011, Port Washington, NY, produced by InterMetro Industries Corp in Case No. 13:18-cv-00116, *SPG International, LLC* v. *InterMetro Industries Corp.*, (12 pages).
"Cantilever Shelving Unit Assembly Instruction," Nexel Industries, instruction sheet, assumed publicly available prior to 2011, produced by InterMetro Industries Corp in Case No. 13:18-cv-00116, *SPG International, LLC* v. *InterMetro Industries Corp*, (2 pages).
"Freestyle Modular Cantilever Shelving System," SPG International, LLC, Covington, GA, specification, 2016, produced by InterMetro Industries Corp in Case No. 13:18-cv-00116, *SPG International, LLC* v. *InterMetro Industries Corp*, (9 pages).
International Search Report and Written Opinion received in International Patent Application No. PCT/US2014/058308, dated Jan. 5, 2015, produced by InterMetro Industries Corp in Case No. 13:18-cv-00116, *SPG International, LLC* v. *InterMetro Industries Corp*, (9 pages).
First Office Action and Search Report from The State Intellectual Property Office of the People's Republic of China for Application No. 201480060558.7, dated Jun. 27, 2017, produced by InterMetro Industries Corp in Case No. 13:18-cv-00116, *SPG International, LLC* v. *InterMetro Industries Corp*, (10 pages).
Extended European Search Report for Application No. 14851078.7, dated Jun. 28, 2017, produced by InterMetro Industries Corp in Case No. 13:18-cv-00116, *SPG Industries, LLC* v. *InterMetro Industries Corp*, (8 pages).
U.S. Appl. No. 15/673,119, filed Aug. 9, 2017, Arturo Gonzalez et al., entitled "Support Bracket," produced by InterMetro Industries Corp in Case No. 13:18-cv-00116, *SPG International, LLC* v. *InterMetro Industries Corp*, (25 pages).
U.S. Appl. No. 15/678,909, filed Aug. 16, 2017, Arturo Gonzalez et al., entitled "Support Bracket," produced by InterMetro Industries Corp in Case No. 13:18-cv-00116, *SPG International, LLC* v. *InterMetro Industries Corp*, (23 pages).
Office Action received in U.S. Appl. No. 14/840,254, dated Sep. 29, 2017, produced by InterMetro Industries Corp in Case No. 13:18-cv-00116, *SPG International, LLC* v. *InterMetro Industries Corp*, (8 pages).
Office Action received in U.S. Appl. No. 15/673,119, dated Oct. 2, 2017, produced by InterMetro Industries Corp in Case No. 13:18-cv-00116, *SPG International, LLC* v. *InterMetro Industries Corp*, (14 pages).
Office Action received in U.S. Appl. No. 15/678,909, dated Oct. 6, 2017, produced by InterMetro Industries Corp in Case No. 13:18-cv-00116, *SPG International, LLC* v. *InterMetro Industries Corp*, (20 pages).
Defendant InterMetro Industries Corp.'s Invalidity Contentions, U.S. District Court, Middle District of Tennessee Nashville Division, *SPG International, LLC* v. *Intermetro Industries Corp*, Case No. 13:18-cv-00116, (28 pages).
Extended European Search Report for Application No. 14775083.0, dated Feb. 15, 2017, produced by InterMetro Industries Corp in Case No. 13:18-cv-00116, *SPG International, LLC* v. *InterMetro Industries Corp*, (8 pages).
First Office Action and Search Report from the State Intellectual Property Office of The People's Republic of China for Application No. 21480024336.X, dated Dec. 28, 2016, produced by InterMetro Industries Corp in Case No. 13:18-cv-00116, *SPG International, LLC* v. *InterMetro Industries Corp*, (16 pages).
"Metro Cantilevered Freestanding Shelving System," InterMetro Industries Corp., article, Wilkes-Barre, PA, 1993, produced by InterMetro Industries Corp in Case No. 13:18-cv-00116, *SPG International, LLC* v. *InterMetro Industries Corp*, (5 pages).
"Material Handling and Industrial Storage Solutions," SPG International, LLC, Covington, GA, Catalog, 2010, (97 pages).
Select components and views of a shelving system, Global Industrial (www.globalindustrial.com), produced by InterMetro Industries Corp in Case No. 13:18-cv-00116, *SPG International, LLC* v. *InterMetro Industries Corp* (19 pages).
"Cantilever Racks," All American Rack Company Warehouse Pallet Rack & Shelving (www.aarack.com/cantilever-racks/cantilever-racks/), produced by InterMetro Industries Corp in Case No. 13:18-cv-00116, *SPG International, LLC* v. *InterMetro Industries Corp* (2 pages).
"E-Z Walk-In Cooler/Freezer Shelving Systems," E-Z Shelving Systems, Inc., Merriam, KS, May 7, 2016, produced by InterMetro Industries Corp in Case No. 13:18-cv-00116, *SPG International, LLC* v. *InterMetro Industries Corp* (8 pages).

(56) References Cited

OTHER PUBLICATIONS

"E-Z Shelving Systems Basic Components," E-Z Shelving Systems, Inc., Merriam, KS, produced by InterMetro Industries Corp in Case No. 13:18-cv-00116, *SPG International, LLC* v. *InterMetro Industries Corp* (1 page).
"E-Z for 50 Years, Cantilever Shelving & Hardware," E-Z Shelving Systems, Inc., Merriam, KS, catalog, 2008, produced by InterMetro Industries Corp in Case No. 13:18-cv-00116, *SPG International, LLC* v. *InterMetro Industries Corp* (4 pages).
"Cantilever," unreferenced image, produced by InterMetro Industries Corp in Case No. 13:18-cv-00116, *SPG International, LLC* v. *InterMetro Industries Corp* (1 page).
"Quick Change Cantilever System," New Age Industrial Corp., Inc., Norton, Kansas, produced by InterMetro Industries Corp in Case No. 13:18-cv-00116, *SPG International, LLC* v. *InterMetro Industries Corp* (2 pages).
"Pick Racks, Trucks & Cantilever Shelving," produced by InterMetro Industries Corp in Case No. 13:18-cv-00116, *SPG International, LLC* v. *InterMetro Industries Corp* (1 page).
"Metro Workspace Adjustable Workstations", InterMetro Industries Corporation, Wilkes-Barre, PA, 2001, produced by InterMetro Industries Corp in Case No. 13:18-cv-00116, *SPG International, LLC* v. *InterMetro Industries Corp* (4 pages).
"Sandwich Unit Refrigerator Model: SW48-12," Continental Refrigerator, Bensalem, PA, catalog, 2013, produced by InterMetro Industries Corp in Case No. 13:18-cv-00116, *SPG International, LLC* v. *InterMetro Industries Corp* (2 pages).
"Cantilever Metal Storage System," E-Z Shelving Systems, Inc., Merriam, KS, Product Guide Specification, Aug. 2011 (21 pages).
"Foodservice Cantilever Metal Storage System," E-Z Shelving Systems, Inc., Merriam, KS, Product Guide Specification, Aug. 2011 (19 pages).
"Shelving," New Age Industrial (www.newageindustrial.com:80/CategoryDetail.aspx?ISC_Category=Shelving), 2008 (1 page).
"New Age Industrial Aluminum Solutions," New Age Industrial Corporation, Inc., catalog, 2012 (72 pages).
"Sandwich Unit Refrigerator Model: SW48-12M-FB-D," Continental Refrigerator, Bensalem, PA, catalog, 2013 (2 pages).
"Sandwich Unit Refrigerator Model: SW48-12-FB," Continental Refrigerator, Bensalem, PA, catalog, 2013 (2 pages).
"Cantilever Shelving—New Age Industrial," (www.newageindustrial.com/PublicStore/Catalog/CategoryInfo.aspx?cid=191&sort=Name&itemsperpage=36&view=Grid&currentpage=1) (11 pages).
"New Age Industrial—Cantilevered Shelving," YouTube page, Apr. 16, 2011 (www.youtube.com/watch?v=Jm5aMXPcTsI) (2 pages).
Exhibit A, "Asserted Claims 1, 2, 3, 5, 7, 9, 11, 12, 14 and 16 of U.S. Pat. No. 9,883,755 are Invalid in View of Karnes," submitted by InterMetro Industries Corp in Case No. 13:18-cv-00116, *SPG International, LLC* v. *InterMetro Industries Corp*, (18 pages).
Exhibit B, "The Asserted Claims of U.S. Pat. No. 9,883,755 are Invalid Over Jensen et al. in View of Kessel et al.," submitted by InterMetro Industries Corp in Case No. 13:18-cv-00116, *SPG International, LLC* v. *InterMetro Industries Corp*, (26 pages).
Exhibit C, "The Asserted Claims of U.S. Pat. No. 9,883,755 are Invalid Over Jensen et al. in View of Mason," submitted by InterMetro Industries Corp in Case No. 13:18-cv-00116, *SPG International, LLC* v. *InterMetro Industries Corp*, (26 pages).
Exhibit D, "The Asserted Claims of U.S. Pat. No. 9,883,755 are Invalid Over Andersson et al. in View of Kessel et al.," submitted by InterMetro Industries Corp in Case No. 13:18-cv-00116, *SPG International, LLC* v. *InterMetro Industries Corp*, (26 pages).
Exhibit E, "The Asserted Claims of U.S. Pat. No. 9,883,755 are Invalid Over Andersson et al. in View of Mason," submitted by InterMetro Industries Corp in Case No. 13:18-cv-00116, *SPG International, LLC* v. *InterMetro Industries Corp*, (26 pages).
Exhibit F, "Asserted Claims 1-3, 5, 7-12, 14-16 and 18 of U.S. Pat. No. 9,883,755 are Invalid under 35 U.S.C. § 112," submitted by InterMetro Industries Corp in Case No. 13:18-cv-00116, *SPG International, LLC* v. *InterMetro Industries Corp*, (10 pages).

* cited by examiner

SUPPORT BRACKET

FIELD OF THE INVENTION

The present invention relates to support brackets, and more particularly to support brackets for shelving systems.

BACKGROUND

Strength and reliability are important issues relevant to shelving systems. In many conventional shelving system designs, a tradeoff exists between strength and reliability and other features, including manufacturability, material costs, and adjustability. Often times, individual shelves experience loading conditions that cause them to fail prematurely. Examples of failure include plastic (i.e., non-elastic) deformation due to bending or buckling, dynamic fracture, and fatigue-induced fracture. Cantilevered shelves are particularly susceptible to these types of failure when subjected to repeated impact loading, for example, when heavy loads are dropped onto the shelf from an appreciable height. Such failure leads to undesirable downtime, repair, or replacement, and the costs associated therewith.

SUMMARY

In one embodiment a shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is adjacent the first retention member. The support bracket further includes a support portion extending from the attachment portion and formed to be disposed substantially about the support member.

In one embodiment a shelving system includes a support post having a mounting surface and a plurality of vertically spaced retention members extending from the mounting surface. A shelf includes a bracket member configured for coupling to a first of the vertically spaced retention members and a support member secured to the bracket member. A support bracket includes an attachment portion having an aperture therethrough formed to receive a second of the vertically spaced retention members, in which the second retention member is adjacent the first retention member. The support bracket further includes a support portion comprising a generally C-shaped region forming a recess. The C-shaped region is formed to be disposed substantially about and to couple to the support member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is spaced from the first retention member along a length of the support post. The support bracket further includes a support portion extending from the attachment portion and configured for supporting the support member.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
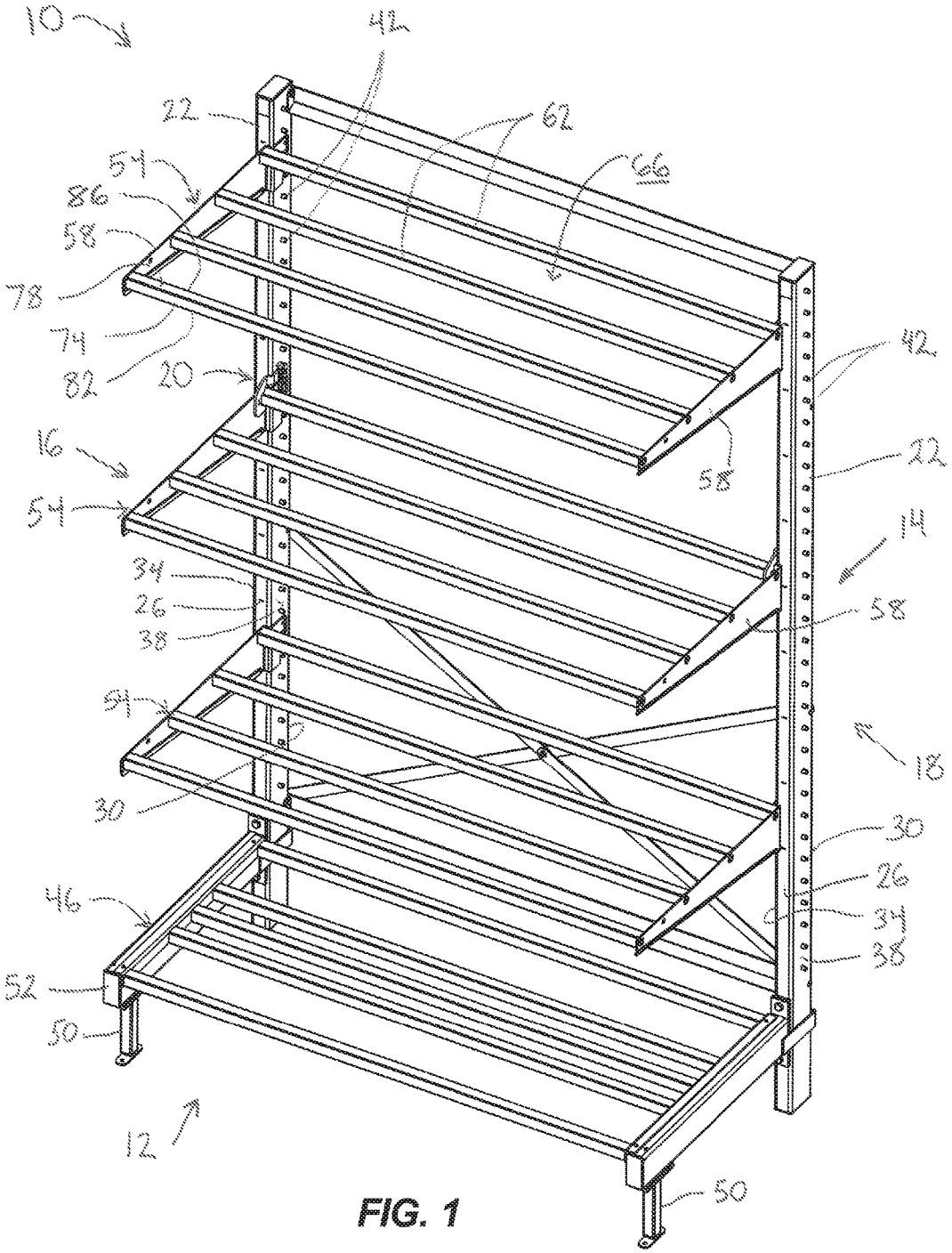
FIG. 1 is a perspective view of a shelving system including a support bracket.

FIG. 1 illustrates an exemplary shelving system 10 including one or more support brackets 20. The shelving system 10 is referenced herein with respect to a proximal end 12, a distal end 14, a left side 16, and a right side 18, the left and right sides 16, 18 referenced when viewed in the distal direction. The shelving system 10 includes a pair of vertical support posts 22 (i.e., left and right support posts 22) erected with respect to a ground or other support surface. Each post 22 defines a proximal side 26, a distal side 30, a left side 34, and a right side 38, and includes a plurality of vertically spaced retention members 42 in the form of support pins extending therethrough and protruding laterally from the left and right sides 34, 38. In the illustrated embodiment, the support pins 42 are spaced a distance of between about one inch and about four inches along the length of each post 22. In other embodiments, the support pins 42 can be spaced equally or unequally from each other. Each pin 42 is preferably press-fit in place but can be secured in any suitable manner generally known to those of skill in the art, e.g., welding, etc. In additional embodiments, the retention members can be in the form of hooks, ledges, or other shaped protrusions and forms affixed or otherwise coupled to each post 22.

A bottom shelf 46 nearest the ground or other support surface extends from the proximal side 26 of the posts 22 and includes a pair of support legs 50 at or near an end 52 that contacts the ground or other support surface to provide stability for the shelving system 10.

With continued reference to FIG. 1, the shelving system 10 includes one or more shelves 54 configured for coupling to the support posts 22. Each shelf 54 is mounted to the posts 22 by way of the support pins 42 and includes lateral brackets 58 with a plurality of support members 62 in the form of cross-braces extending therebetween to provide a generally planar support surface 66 for the shelf 54. Each of the support members 62 includes a proximal side 74 substantially perpendicular to the planar support surface 66, a top side 78 adjacent the planar support surface 66, a bottom side 82 opposite the top side 78, and a distal side 86 opposite the proximal side 74. As such, the illustrated support members 62 have a generally rectangular cross-section. However, other embodiments of a shelf 54 can include support members 62 having any other regularly or irregularly shaped cross-section, while still maintaining generally designated sides. For example, a support member having a circular cross-section (not shown) is oriented by definition to include top, bottom, front, and rear sides despite not having distinct surfaces separated by corners. In yet other embodiments, the lateral brackets 58 can be connected by a frame, sheet, series of bars or poles, mesh, screen, grate, or other form of support member extending between the lateral brackets 58 for purposes of supporting weight, through either direct contact or optionally through a separate supporting surface cover or platform upon which to store and/or display articles.

Figure 2:
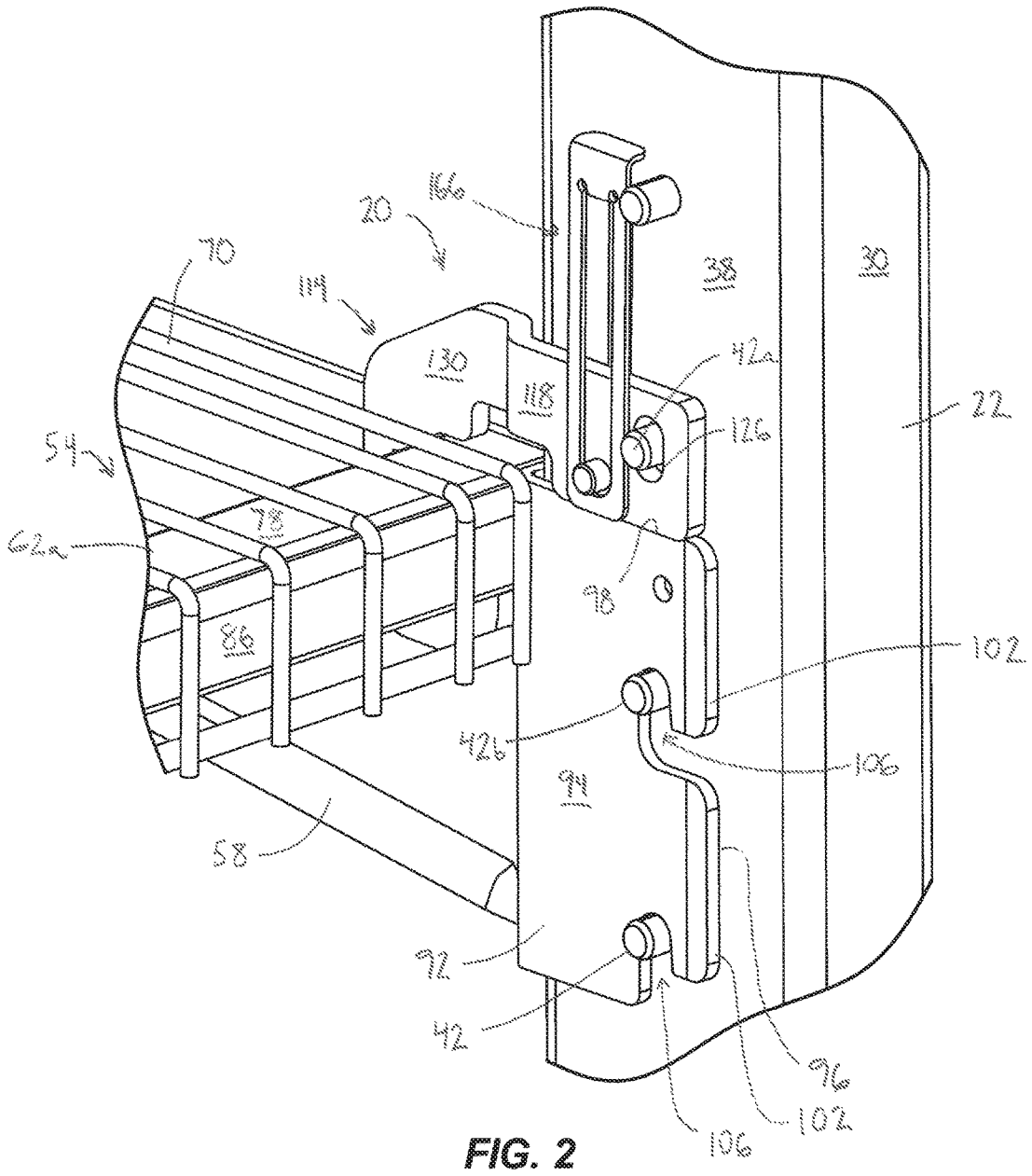
FIG. 2 is a partial perspective view of the shelving system showing the bracket identified in FIG. 1.
Figure 3:
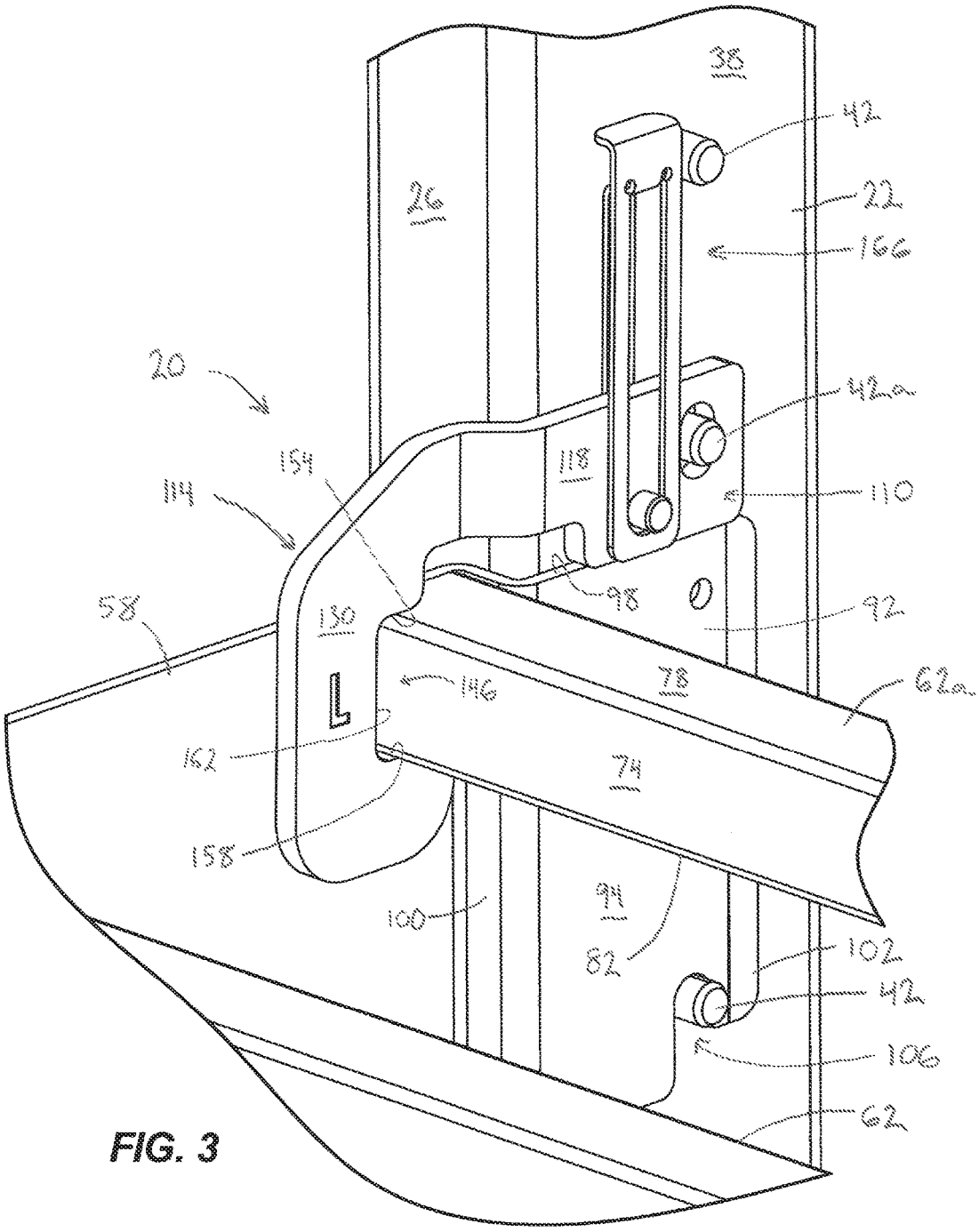
FIG. 3 is another partial perspective view of the shelving system showing the bracket identified in FIG. 1.

Referring to FIGS. 2 and 3, each of the lateral brackets 58 includes a flange member 92 having a first side 94 opposite the support post 22 when coupled thereto, a second side 96 adjacent the support post 22, and a top side 98 extending between the first side 94 and the second side 96. The flange member 92 also includes a bearing surface 100 adjacent and generally parallel to the proximal side 26 of the support post 22. Contact between the bearing surface 100 and the proximal side 26 prevents rotation of the shelf 54 on the post 22 due to the weight of the shelf 54 and additional loading placed upon the support members 62.

In the illustrated embodiment, the flange members 92 include a plurality of distally-extending fingers 102 or hooks that curve downward to form recesses 106. The recesses 106 each receive and removably secure a pin 42 to mount the shelf 54 to the post 22, preventing translational and rotational movement of the shelf due to loading forces. The fingers 102 or hooks can be equally or unequally spaced but are positioned to correspond to the support pins 42.

Figure 7:
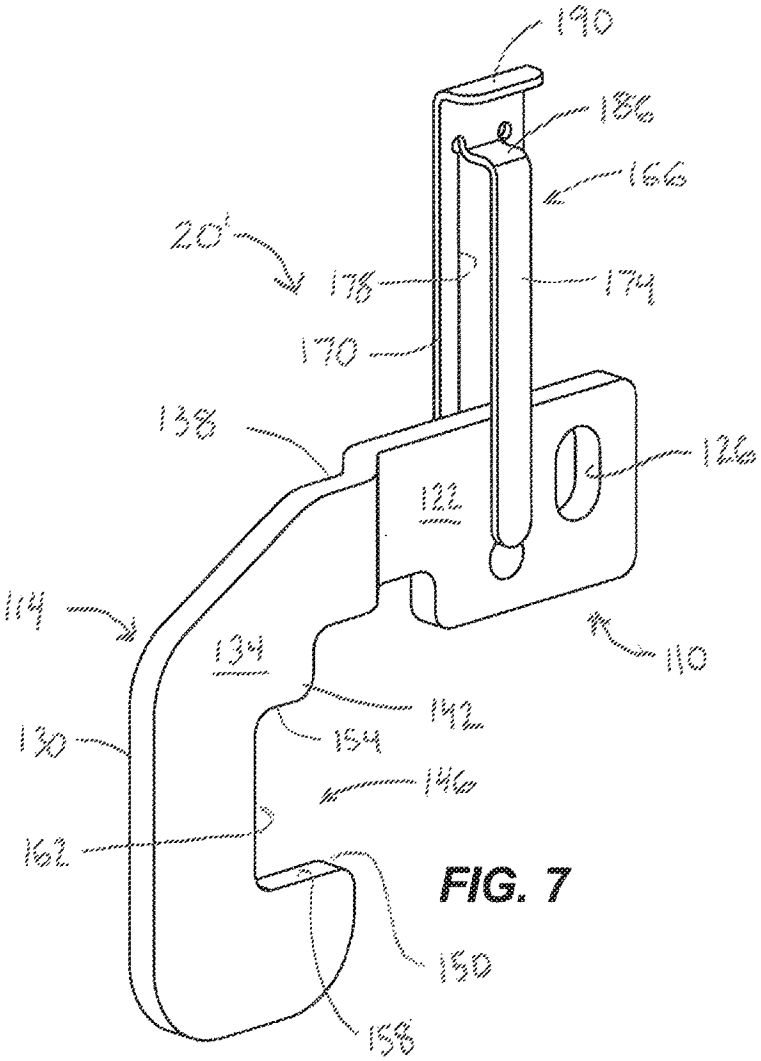
FIG. 7 is another perspective view of the support bracket of FIG. 6.

The support bracket 20, to be hereinafter described with reference to FIGS. 2-5, 8, and 9, is configured as a left-side bracket for coupling generally to the left side 16 of the shelving system 10. FIGS. 6 and 7 illustrate another support bracket 20' configured as a right-side support bracket for coupling generally to the right side of the shelving system 10. In other embodiments, the support brackets 20, 20' can be incorporated into the shelving system individually (e.g., for a shelving system having a single support post). The support bracket 20' of FIGS. 6 and 7 is a mirror image of the support bracket 20. As such, the support bracket 20' will not be described in detail herein, and like features of the support brackets 20 and 20' have been given like reference numerals.

Although the support bracket 20 is described with respect to the shelving system 10 illustrated in FIG. 1, it should be understood that various embodiments of the support bracket 20 can be used with other types of shelving systems.

The support bracket 20 includes an attachment portion 110 and a support portion 114 continuously extending from the attachment portion 110. The attachment portion 110 includes a first side 118, a second side 122 opposite the first side 118, and an aperture 126 extending from the first side 118 to the second side 122. The aperture 126 is configured to receive a pin 42 projecting from the post 22 to couple the attachment portion 110 to the post 22. In other embodiments, the attachment portion 110 can be sized to include two or more apertures 126 to receive two or more pins 42 of the post 22. Alternative engagement features for coupling the attachment portion 110 with the post 22 or with posts of other shelving systems are within the scope of the present invention.

In the illustrated embodiment, the support bracket 20 is positioned on the post 22 with the second side 122 of the attachment portion 110 generally parallel and adjacent to the post 22, specifically the right side 38 of the post 22 (or the left side 34 for a support bracket 20'). The attachment portion 110 is positioned vertically adjacent the flange member 92 of a lateral bracket 58, and the aperture 126 of the attachment portion 110 receives the pin 42*a* adjacent the pin 42*b* engaged with the fingers 102 on the flange member 92, as illustrated in FIG. 2. As such, a portion of the support bracket 20 is positioned directly above the shelf 54. As shown in FIGS. 2 and 3, the attachment portion 110 abuts the top side 98 of the flange member 92, but in other embodiments, the attachment portion 110 can be spaced from the top side 98 of the flange member 92 and need not receive the pin adjacent the pin 42*b* (e.g., dependent on the spacing of the pins 42, the position of the aperture 126, or the shape of the attachment portion 110). In yet other embodiments, by varying the connection of the attachment portion 110 to the support portion 114, the support bracket 20 can be coupled to the post 22 such that the second side 122 of the attachment portion 110 is positioned laterally adjacent the flange member 92. In such an embodiment, the attachment portion 110 and the flange member 92 can be coupled to the same pin(s) 42.

Figure 5:
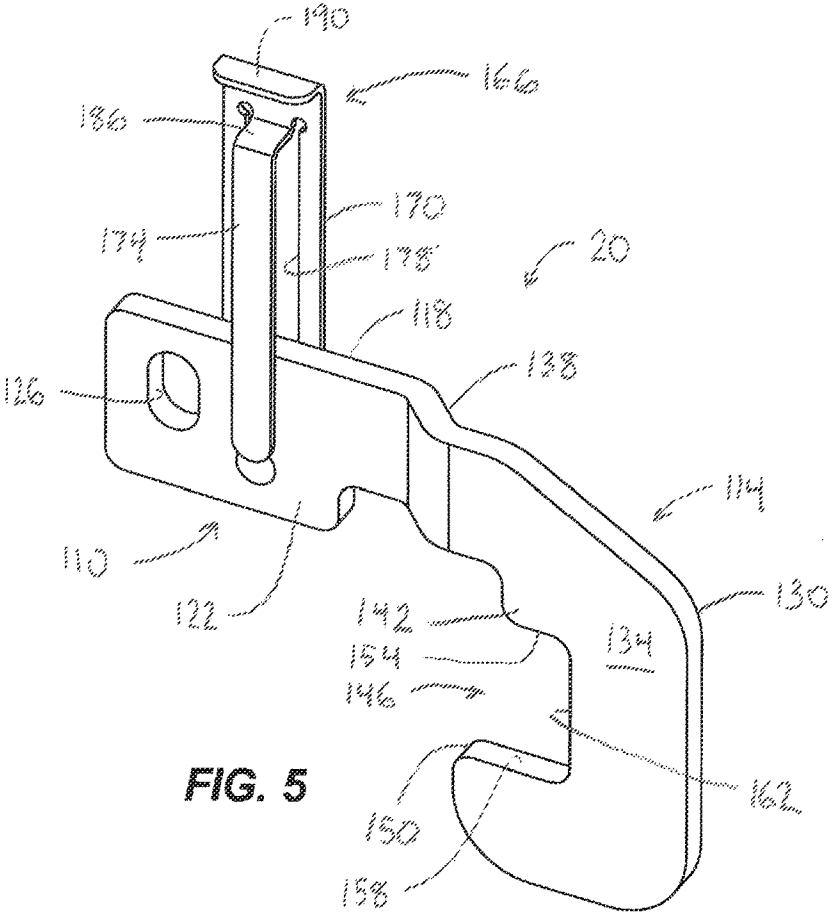
FIG. 5 is another perspective view of the support bracket of FIG. 2.
Figure 4:
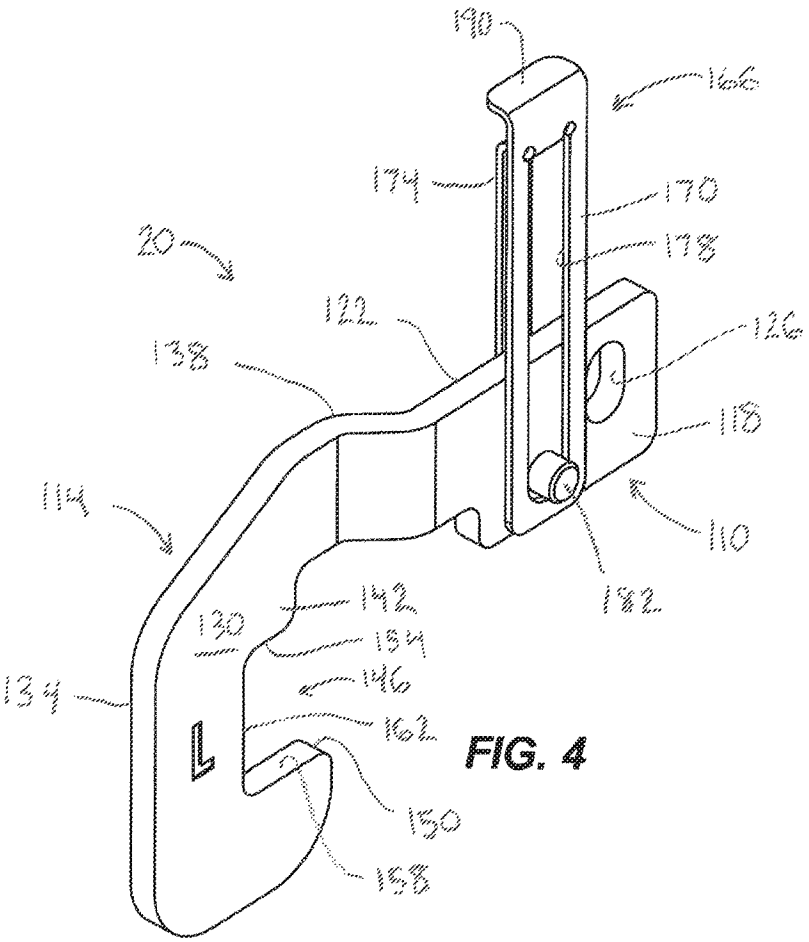
FIG. 4 is a perspective view of the support bracket of FIG. 2.
Figure 6:
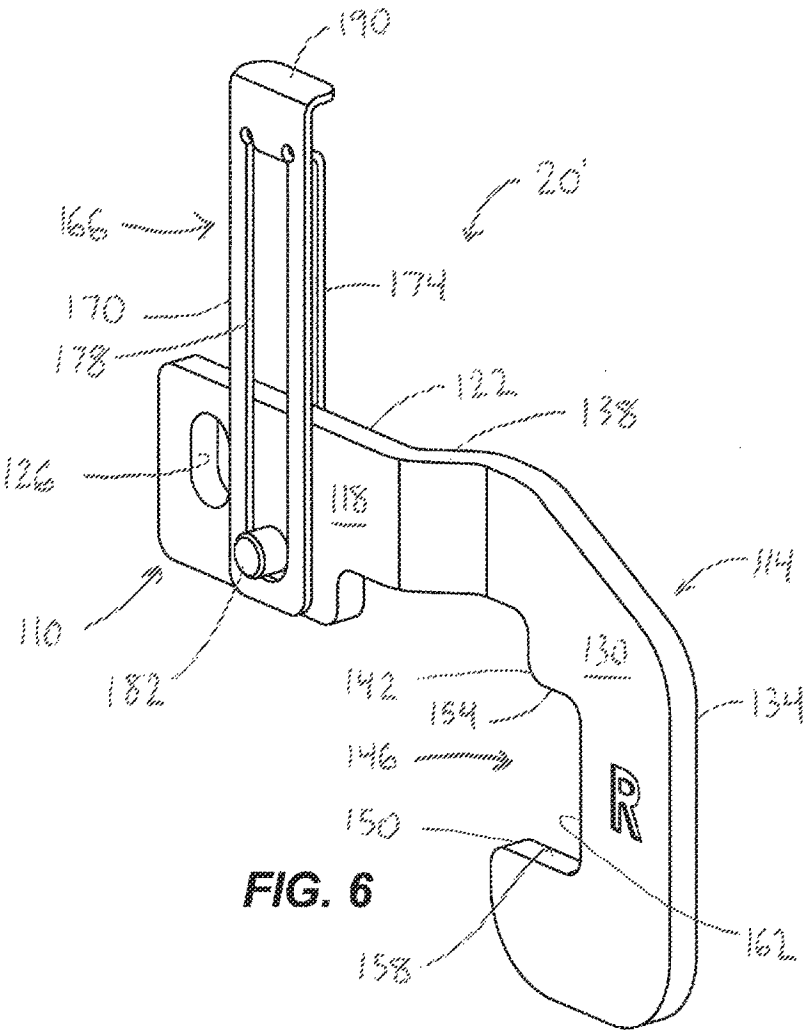
FIG. 6 is a perspective view of another support bracket for use with the shelving system of FIG. 1.
Figure 9:
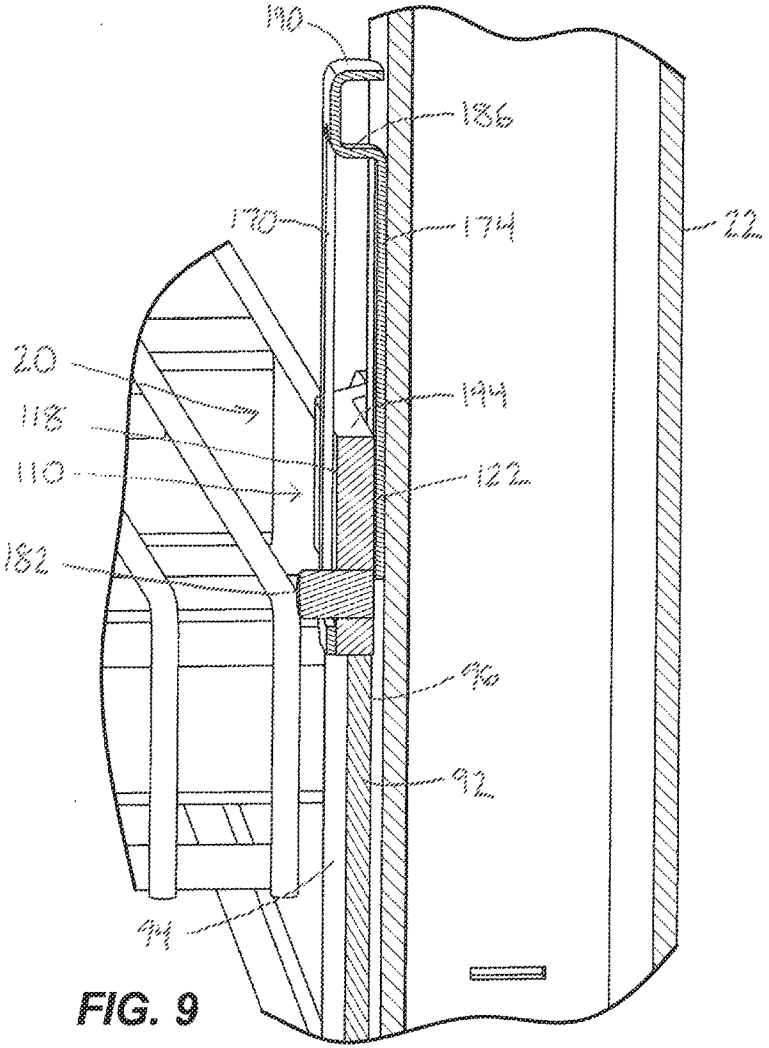
FIG. 9 is a cross-sectional view of a portion of the shelving system of FIG. 1, showing the lock member of the support bracket in an unlocked position.

Referring to FIGS. 4 and 5, the support portion 114 includes a first side 130 substantially parallel with the first side 118 of the attachment portion 110, and a second side 134 opposite the first side 130. A curved transition region 138 offsets the attachment portion 110 from the support portion 114. In other embodiments, the first and second sides 130, 134 of the support portion 114 can be generally coplanar with the first and second sides 118, 122 of the attachment portion 110. The support portion 114 further includes a generally C-shaped region 142 extending downward from the support portion (relative to the orientation of FIGS. 4 and 5). The C-shaped region 142 forms a recess 146 having an opening 150 oriented toward the attachment portion 110. The recess 146 is further defined by an upper wall 154, a lower wall 158, and an intermediate wall 162 extending between the upper wall 154 and the lower wall 158. The walls 154, 158, and 162 are configured to engage the distal support member 62*a* of the shelf 54 (when mounted to the post 22). Accordingly, in other embodiments, the recess 146 can have other shapes and/or orientations suitable to engage with the support member 62*a* or other shaped or sized member extending between lateral brackets 58 and supporting or otherwise forming the support surface cover or platform 66 upon which to store and/or display articles. For example, in some embodiments, the recess 146 can include a single curved wall to engage with a support member having a circular cross-section. In other embodiments with alternative mounting of the attachment portion 110, the C-shaped region 142 can extend upward from the support portion 114 to engage the support member 62*a*.

With reference to FIG. 3, the recess 146 of the support portion 114 is disposed about a portion of the distal support member 62*a* of the shelf 54 to engage and secure or otherwise support the support member 62*a* when the support bracket 20 is installed on the post 22. The upper wall 154 is positioned adjacent the top side 78 of the distal support member 62*a*, the intermediate wall 162 is positioned adjacent the proximal side 74 of the distal support member 62*a*, and the lower wall 158 is positioned adjacent the bottom side 82 of the distal support member 62*a*, i.e., the support portion 114 is disposed substantially about the support member 62*a*. At least one of the sides (e.g., the bottom side 82 and/or the proximal side 74) of the distal support member 62*a* contacts or bears against the adjacent wall (i.e., the lower 158 and/or intermediate wall 162) to transmit loading from the lateral bracket 58 through the distal support member 62*a* to the support bracket 20. The support bracket 20 then transmits this loading to the support post 22. Accordingly, the support bracket 20 reduces the stresses experienced by the lateral bracket 58 and strengthens the shelving system 10.

The support brackets 20, 20' are preferably formed from a single piece of metal, for example, by a stamping or cutting process.

Referring to FIGS. 4, 5, 8, and 9, the support bracket 20 includes a lock member 166 slidable relative to the support bracket 20 between an unlocked position (FIG. 9) in which the lock member 166 permits movement of the support bracket 20 relative to the flange member 92 and a locked position (FIG. 8) in which the lock member 166 inhibits movement of the support bracket 20 relative to the flange member 92. The lock member 166 includes a first leg 170 adjacent the first side 118 of the attachment portion 110 and a second leg 174 adjacent the second side 122 of the attachment portion 110. The first leg 170 includes a slot 178 extending therethrough, which receives a laterally extending projection 182 of the attachment portion 110 to couple the lock member 166 to the attachment portion 110. The slot 178 is slidable along the projection 182 as the lock member 166 moves between the locked position and the unlocked position. The lock member 166 also includes a connecting portion 186 extending between the first and second legs 170, 174, and an upper surface 190 extending generally perpendicular to the legs 170, 174 to facilitate positioning of the lock member 166. In the illustrated embodiment, the lock member 166 is integrally formed from a single piece of metal. For example, the second leg 174 can be stamped or cut from the first leg 170 to thereby define the slot 178, then bent to laterally offset the second leg 174 from the first leg 170, forming the connecting portion 186. In other embodiments, the lock member 166 can be formed from multiple pieces and/or through any suitable process.

Figure 8:
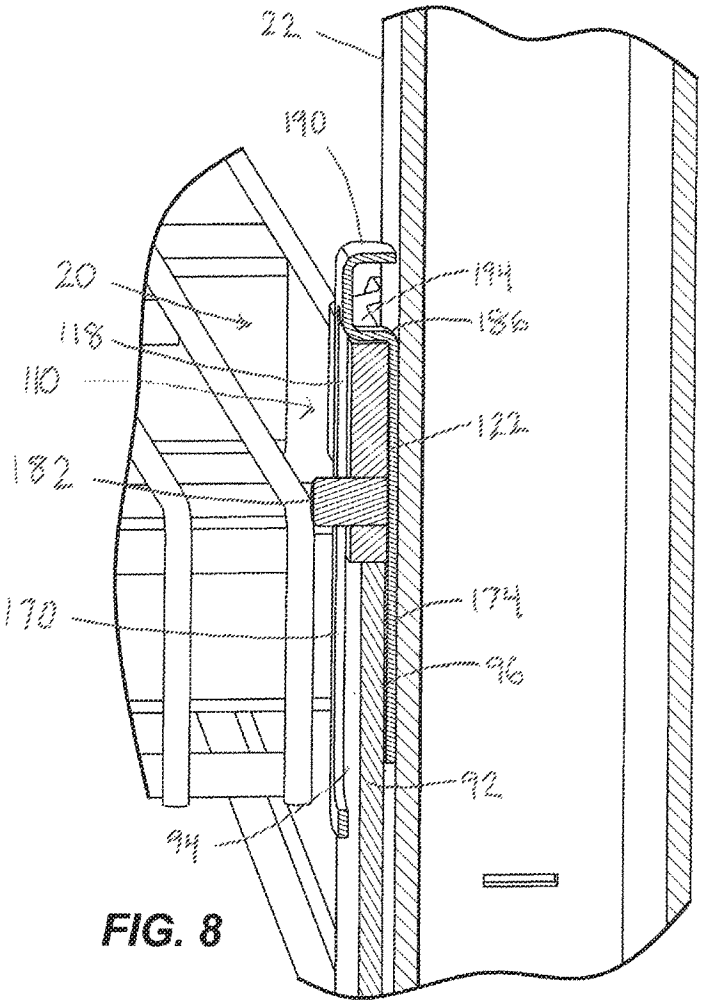
FIG. 8 is a cross-sectional view of a portion of the shelving system of FIG. 1, showing a lock member of the support bracket in a locked position.

With reference to FIG. 8, in the locked position, the connecting portion 186 of the lock member 166 abuts a top side 194 of the attachment portion 110 to provide an indication that the lock member 166 is fully engaged in the locked position. In the locked position of FIG. 8, the first leg 170 of the lock member 166 spans across both the first side 118 of the attachment portion 110 and the first side 94 of the flange member 92. Similarly, the second leg 174 of the lock member 166 spans across the second side of the attachment portion and the second side 96 of the flange member 92, disposed in the space defined between the surface 122 of bracket 20 and surface 96 of flange member 92, on the one hand, and the surface 38 of support post 22, on the other hand. As such, the attachment portion 110 and the flange member 92 are captured between the first and second legs 170, 174 of the lock member 166 and held in alignment. This prevents lateral movement of the support bracket 20 relative to the flange member 92 and keeps the bracket 20 in its optimal position for providing support to the shelf 54.

The support brackets 20 and 20' thereby assist in mitigating the mechanical stresses developed in the lateral brackets 58 due to shelf loading, such as impact loading, by providing a countering force to such loading. The support bracket can be readily installed without the need for any tools or external devices to new or existing shelving systems having a variety of different configurations, shelf depths, and lengths.

Various features of the invention are set forth in the following claims.

What is claimed is:

1. A shelving system comprising:

a pair of support posts, each support post having a mounting portion presenting a plurality of retention members, each retention member of the plurality of retention members formed as a pin that is fixed to and extends laterally outwardly from the mounting portion of each support post, and each support post having an abutment portion orthogonal to the mounting portion, wherein the abutment portion defines a plane;

a shelf; and an assembly including a pair of first support brackets, each first support bracket having a flange configured to engage two retention members of the plurality of retention members on an associated support post of the pair of support posts and to support the shelf such that in an assembled state of the shelving system one first support bracket of the pair of first support brackets is associated with one support post of the pair of support posts and an other first support bracket of the pair of first support brackets is associated with an other support post of the pair of support posts, wherein the flange of each first support bracket includes apertures each formed as a slot with an open end to engage any one of the retention member of the plurality of retention members on the associated support post, and an elongated portion coupled to the flange and configured such that in the assembled state of the shelving system the elongated portion is supported on the associated support post by the flange and extends away from the associated support post to support one side of the shelf; and a pair of second support brackets, each second support bracket configured such that in the assembled state of the shelving system each second support bracket cooperates with an associated first support bracket of the pair of first support brackets such that one second support bracket of the pair of second support brackets is associated with the one first support bracket of the pair of first support brackets and an other second support bracket of the pair of second support brackets is associated with the other first support bracket of the pair of first support brackets to support the shelf, each second support bracket of the pair of second support brackets independent and separable from the associated first support bracket of the pair of first support brackets, each second support bracket including a first portion configured such that in the assembled state of the shelving system the first portion contacts the associated first support bracket of the pair of first support brackets, a second portion including a recess region, the second portion configured such that in the assembled state of the shelving system the recess region partially surrounds and supports a portion of the shelf to hinder movement of the shelf away from the pair of support posts in a direction perpendicular to the plane, and a third portion disposed between the first portion and the second portion, wherein each second support bracket is configured such that in the assembled state of the shelving system the third portion cooperates with the first portion to position the recess region adjacent the elongated portion of the associated first support bracket, wherein each second support bracket is configured such that in the assembled state of the shelving system the recess region of each second support bracket is disposed above an aperture of the associated first support bracket of the pair of first support brackets, the aperture of the associated first support bracket of the pair of first support brackets engaged with one retention member of the plurality of retention members, and wherein each first support bracket is configured such that in the assembled state of the shelving system a portion of each first support bracket abuts the abutment portion of the associated support post of the pair of support posts.

2. The shelving system of claim 1, wherein each second support bracket is configured such that in the assembled state of the shelving system the second portion of each second support bracket extends downward from the third portion of each second support bracket.

3. The shelving system of claim 1, wherein each second support bracket is configured such that in the assembled state of the shelving system the recess region of each second support bracket engages and supports a bottom portion of the shelf.

4. The shelving system of claim 1, wherein the mounting portion of each support post of the pair of support posts comprises two opposed support surfaces that face away from each other and the abutment portion comprises a third surface that extends between the two opposed support surfaces.

5. The shelving system of claim 4, wherein each second support bracket of the pair of second support brackets is configured such that upon receiving of the portion of the shelf by the recess region, the recess region is constrained from movement toward the plane.

6. The shelving system of claim 4, wherein each second support bracket of the pair of second support brackets is configured such that upon receiving of the portion of the shelf by the recess region, the recess region constrains movement of the shelf away from the plane.

7. The shelving system of claim 4, wherein the mounting portion of each of the pair of support posts further comprises a first transition surface between one of the pair of opposed support surfaces and the third surface and a second transition surface between an other of the pair of opposed support surfaces and the third surface.

8. The shelving system of claim 1, wherein the third portion of each second support bracket is offset from the first and second portions of each second support bracket.

9. The shelving system of claim 1, wherein the assembly is configured such that in the assembled state of the shelving system the assembly supports the shelf such that a top side of the shelf does not extend above a top side of each first support bracket of the pair of first support brackets.

10. The shelving system of claim 1, wherein the assembly is configured such that in the assembled state of the shelving system the assembly supports a bottom side of the shelf above a bottom side of each first support bracket of the pair of first support brackets.

11. The shelving system of claim 1, wherein each second support bracket of the pair of second support brackets is configured such that in the assembled state of the shelving system the recess region of each second support bracket of the pair of second support brackets is disposed above a bottom side of the associated first support bracket of the pair of first support brackets.

12. The shelving system of claim 1 wherein each first support bracket of the pair of first support brackets is configured such that in the assembled state of the shelving system one of the apertures of each first support bracket of the pair of first support brackets opens in a first direction away from the shelf and another of the apertures of each first support bracket of the pair of first support brackets opens in a second direction different from the first direction.

13. The shelving system of claim 4, wherein the first portion of each second support bracket of the pair of second support brackets includes a pair of spaced-apart parallel projections configured such that in the assembled state of the shelving system the pair of spaced-apart parallel projections limits relative lateral movement between each second support bracket of the pair of second support brackets and the associated first support bracket.

14. The shelving system of claim 13, wherein the first portion of each second support bracket includes a body and the pair of spaced-apart parallel projections extends from the body.

15. The shelving system of claim 14, wherein one of the pair of spaced-apart parallel projections is configured such that in the assembled state of the shelving system one projection extends above a top surface of the body.

16. A shelving system comprising:

a pair of support posts, each support post having a mounting portion presenting a plurality of retention members, each retention member of the plurality of retention members formed as a pin that is fixed to and extends laterally outwardly from the mounting portion of each support post, and each support post having an abutment portion orthogonal to the mounting portion, wherein the abutment portion defines a plane;

a pair of first support brackets, each first support bracket having a flange portion configured to engage selected retention members of the plurality of retention members on an associated support post of the pair of support posts such that in an assembled state of the shelving system one first support bracket of the pair of first support brackets is associated with one support post of the pair of support posts and an other first support bracket of the pair of first support brackets is associated with an other support post of the pair of support posts, the flange portion of each first support bracket including a plurality of apertures each formed as a slot with an open end and configured to engage any one of the selected retention members of the plurality of retention members, and an elongated portion coupled to the flange portion and configured such that in the assembled state of the shelving system the elongated portion is supported on the associated support post by the flange portion and extends away from the associated support post to support one side of a shelf;

a pair of second support brackets, each second support bracket associated with and separable from a first support bracket of the pair of first support brackets such that one second support bracket of the pair of second support brackets is associated with the one first support bracket of the pair of first support brackets and an other second support bracket of the pair of second support brackets is associated with the other first support bracket of the pair of first support brackets, wherein each second support bracket is configured such that in the assembled state of the shelving system each second support bracket, along with the associated first support bracket of the pair of first support brackets, supports a side of the shelf, each second support bracket including a first portion to support the second support bracket adjacent the associated first support bracket of the pair of first support brackets, wherein the first portion is configured such that in the assembled state of the shelving system the first portion contacts the associated first support bracket to support the second support bracket on the first support bracket, and a second portion coupled with the first portion, wherein the first portion supports the second portion on the associated first support bracket and the second portion defines a C- shaped recess, wherein each first support bracket of the pair of first support brackets is configured such that in the assembled state of the shelving system a portion of each first support bracket abuts the abutment portion of the associated support post of the pair of support posts and each second support bracket of the pair of second support brackets is configured such that in the assembled state of the shelving system the C-shaped recess of the second portion of each second support bracket receives a portion of the shelf to hinder movement of the shelf away from the pair of the support posts in a direction perpendicular to the plane, and wherein each second support bracket of the pair of second support brackets is configured such that in the assembled state of the shelving system the C-shaped recess is positioned adjacent the elongated portion of the associated first support bracket of the pair of first support brackets to support the one side of the shelf in cooperation with the elongated portion of the associated first support bracket of the pair of first support brackets, and wherein each second support bracket supports a bottom side of the shelf above a bottom side of the associated first support bracket of the pair of first support brackets.

17. The shelving system of claim 16, wherein each second support bracket of the pair of second support brackets is configured such that in the assembled state of the shelving system each second support bracket abuts the associated first support bracket of the pair of first support brackets.

18. The shelving system of claim 16, wherein each second support bracket of the pair of second support brackets is configured such that in the assembled state of the shelving system a portion of the C-shaped recess of each second support bracket is disposed below a top surface of the associated first support bracket of the pair of first support brackets.

19. The shelving system of claim 16, wherein the pair of the first support brackets and the pair of the second support brackets are configured such that in the assembled state of the shelving system the pair of first support brackets and the pair of second support brackets support the shelf such that a top side of the shelf does not extend above a top side of each first support bracket of the pair of first support brackets.

20. The shelving system of claim 16, wherein the mounting portion of each of the pair of support posts comprises a pair of opposed surfaces facing away from one another, and each retention member of the plurality of retention members is fixed to and extends laterally outwardly away from each surface of the pair of opposed surfaces of each support post, and wherein the abutment portion comprises a surface that extends between the pair of opposed surfaces.

21. The shelving system of claim 20, wherein each second support bracket of the pair of second support brackets is configured such that upon receiving of the portion of the shelf by the C-shaped recess, the C-shaped recess, defined by the second portion, is constrained from movement toward the plane.

22. The shelving system of claim 20, wherein each second support bracket of the pair of second support brackets is configured such that upon receiving of the portion of the shelf by the C-shaped recess, the C-shaped recess, defined by the second portion, constrains movement of the shelf away from the plane.

23. The shelving system of claim 20, wherein the mounting portion of each of the pair of support posts further comprises a first transition surface between one of the opposed surfaces and the surface of the abutment portion and a second transition surface between an other of the pair of opposed surfaces and the surface of the abutment portion.

24. The shelving system of claim 16, wherein the first portion of each second support bracket of the pair of second support brackets includes a pair of spaced-apart parallel projections configured such that in the assembled state of the shelving system the pair of spaced-apart parallel projections limits relative lateral movement between each second support bracket of the pair of second support brackets and the associated first support bracket.

25. The shelving system of claim 24, wherein the first portion of each second support bracket includes a body and the pair of spaced-apart parallel projections extends from the body.

26. The shelving system of claim 25, wherein one of the pair of spaced-apart parallel projections is configured such that in the assembled state of the shelving system one projection extends above a top surface of the body.

* * * * *